US010405664B1

(12) United States Patent
Wrazel

(10) Patent No.: US 10,405,664 B1
(45) Date of Patent: Sep. 10, 2019

(54) CARRY CUSHION

(71) Applicant: Fred Wrazel, Fresno, CA (US)

(72) Inventor: Fred Wrazel, Fresno, CA (US)

( * ) Notice: Subject to any disclaimer, the term of this patent is extended or adjusted under 35 U.S.C. 154(b) by 0 days.

(21) Appl. No.: 15/999,894

(22) Filed: Aug. 29, 2018

(51) Int. Cl.
*A47C 7/02* (2006.01)
*A45C 9/00* (2006.01)
*A47C 7/42* (2006.01)

(52) U.S. Cl.
CPC ..... *A47C 7/021* (2013.01); *A45C 9/00* (2013.01); *A47C 7/425* (2013.01)

(58) Field of Classification Search
USPC ..... 297/229
See application file for complete search history.

(56) References Cited

U.S. PATENT DOCUMENTS

| | | | | |
|---|---|---|---|---|
| 4,597,605 | A * | 7/1986 | Gilbert | A47C 7/425 297/183.5 |
| 5,297,848 | A * | 3/1994 | Grinnell | A47C 7/029 297/219.1 |
| 5,785,427 | A * | 7/1998 | Godshaw | A45F 4/02 383/4 |
| 8,939,505 | B1 * | 1/2015 | Dreyer | A47C 20/02 297/219.1 |
| 10,123,632 | B2 * | 11/2018 | Whitted | A47C 1/02 |
| 2001/0035672 | A1 * | 11/2001 | Graff | A47C 1/14 297/229 |
| 2002/0029832 | A1 * | 3/2002 | Carlson | A45C 9/00 150/110 |

* cited by examiner

*Primary Examiner* — Sarah B McPartlin

(57) ABSTRACT

While seat cushions are as old as time, my Carry Cushion is a unique application which covers both the seat and the back of a folding chair. When not in use on a folding or bridge chair, my Carry Cushion converts to a handy tote bag to be carried to wherever the carrier plans to use it, while toting in the bag food, drink, blankets. etc. Hence my name for my handy and unique invention.

1 Claim, 2 Drawing Sheets

CARRY CUSHION

The inspiration for my Carry Cushion came from having to sit for two grueling hours on cold, hard metal folding chairs at a funeral. For my wife, who has scoliosis, it was especially painful.

The Carry Cushion is specifically designed to pad both the seat and the back of bridge or folding chairs, be they metal, wood or plastic. There are millions of these chairs in North America—in schools, churches, meeting halls, offices, etc.

There is nothing new about seat pads or pillows. But when a user heads out to be confronted by a folding chair, the Carry Cushion will not only be a convenient way to bring padding for both the back and seat of the chair, it will also serve as a very handy and attractive tote bag for whatever might suit the occasion—purse, food and drink, clothes, coverlet, books—you name it. No need to lug along a blanket or pad to make that dreaded chair less uncomfortable. The Carry Cushion will provide a much quicker, easier and far more satisfactory solution!

The Carry Cushion, my convertible seat pad—tote bag brain child, will be made of sturdy light canvas or duck cloth. The padding will be ½" to ¾" thick, flexible, made of quilted cotton padding or sponge rubber. The insert that will lay on the seat will be covered by the same material as the tote bag. The padding for the chairback will be sewn into place on the inside of the side of the tote bag to which the seat cover is attached.

Here are the dimensions of my prototype, designed to fit all standard folding chairs:

(1) The bottom panel of the tote bag, which will convert to fit across the top back of the chair, is 2" by 16".

(2) The two broad sides of the tote bag, which will convert to cover the front and back of the chair's back, will be 16" high by 14" wide.

(3) The two narrow side panels, which will extend from the bottom of the tote bag to the open top, will taper from 2" at the bottom to 3" at the top. NOTE: At the tops of these two narrow side panels, an elastic gusset will be inserted, 3" wide by 6" deep, to accommodate folding chairs with side hinges.

(4) The flexible seat pad, which is 15" square, will be covered with the same tote bag material, and will be attached to the padded side of the tote bag with a 3" by 14" cloth strip, which will act as a hinge as the seat pad is folded in and out of the tote bag. This will allow for some adjustment of the pad on the chair. On the bottom of the seat pad will be sewn large patches of non-skid fabric to hold the seat pad in place.

(5) The top of the tote bag will be fitted with two cloth handles about 14" long, and set about 8" wide.

The basic Carry Cushion can also be made with a variety of colors and materials, and with removable or detachable pads. School colors, logos, emblems, advertisements and artwork can be incorporated to suit buyers.

So this is my Carry Cushion, sufficiently unique to merit patenting!

Feature 1 is front surface of tote bag, with ½ inch quilted padding fixed on inside of said surface.

Feature 2 is flexible insert, to allow for chair hinges.

Feature 3 is light-weight strip connecting seat pad to tote bag.

Feature 4 is one of two handles attached to top to tote bag.

Feature 5 is large patch of non-skid material to hold seat pads secure.

Feature 6 is the seat pad, made of the same material as tote bag, enclosing half-inch thick flexible quilted padding, ensuring easy insert and removal from tote bag.

Feature 7 shows Carry Cushion reassembled as tote bag, with handles, elastic strip, and strip connecting tote bag to seat pad showing.

Figure 1:
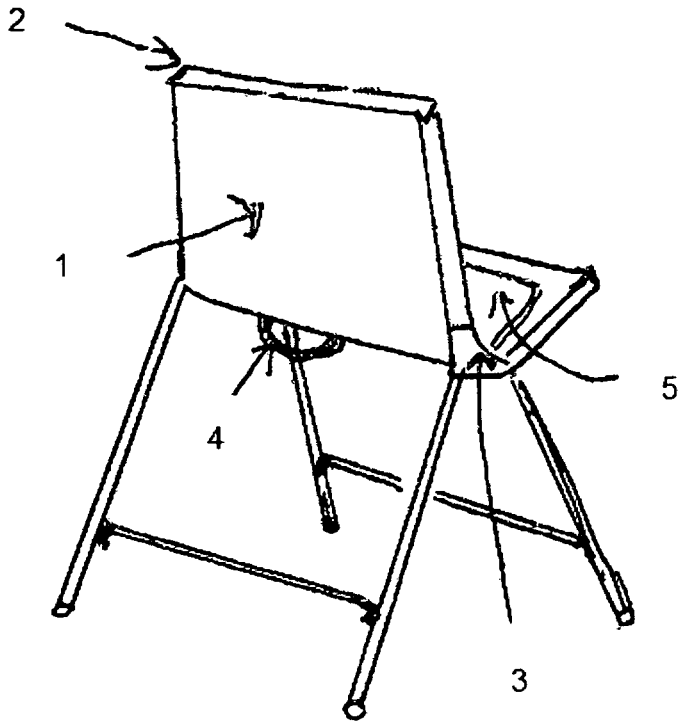
FIG. 1. Employment of Carry Cushion
Figure 2A:
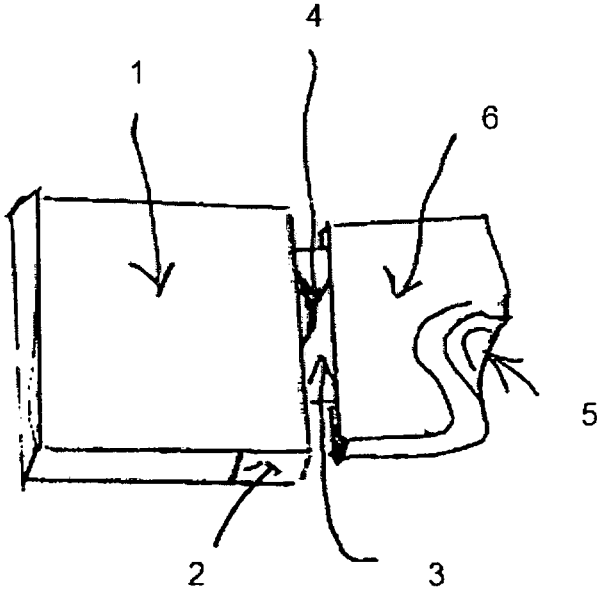

FIG. 2*a*. Open Carry Cushion Ready to Employ

Feature 1 is front surface of tote bag, with ½ inch quilted padding fixed on inside of said surface.

Feature 2 is flexible insert, to allow for chair hinges.

Feature 3 is light-weight strap connecting seat pad to tote bag.

Feature 4 is one of two handles attached to top of tote bag.

Feature 5 is large patch of non-skid material to hold seat pads secure.

Feature 6 is the seat pad, made of the same material as tote bag, enclosing half-inch thick flexible quilted padding, ensuring easy insert and removal from tote bag.

Figure 2B:
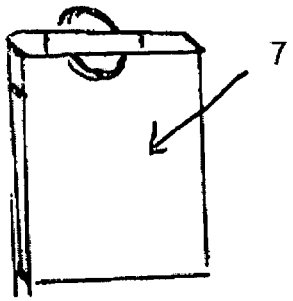

FIG. 2*b*. Carry cushion reassembled as tote bag with handles, elastic strip and strip connecting tote bag to seat pad showing.

Feature 7 shows Carry Cushion reassembled as tote bag, with handles, elastic strip, and strip connecting tote bag to seat pad showing.

The invention claimed is:

1. A convertible tote bag and seat cushion comprising: a tote bag body comprising:

a tote bag bottom panel configured to cover a top edge of a seat back of a chair;

two broad tote bag side panels each configured to cover a front surface of the seat back and a rear surface of the seat back respectively, wherein an inside surface of the broad tote bag side panel configured to cover the front surface of the seat back comprises padding;

two narrow tote bag side panels with tapered sides connecting the tote bag bottom panel and two broad tote bag side panels;

an elastic gusset extending from a top of each of the two narrow tote bag side panels for accommodating a chair hinge;

two handles attached to a top edge of each of the two broad tote bag side panels opposite the tote bag bottom panel;

a cloth hinge strip attached to the broad tote bag side panel configured to cover the front surface of the seat back; and a flexible seat pad attached to the cloth hinge strip, wherein the flexible seat pad includes patches of non-skid fabric sewn to an underside, the flexible seat pad is configured deploy from a storage position wherein the flexible seat pad is positioned within the tote bag body to a use position in which the flexible seat pad covers a seat of the chair.

* * * * *